US007043812B1

(12) United States Patent
Nakajo et al.

(10) Patent No.: US 7,043,812 B1
(45) Date of Patent: May 16, 2006

(54) APPARATUS AND METHOD FOR BUTTON INDEXING IN BUTTON ATTACHING MACHINE, AND METHOD OF ADJUSTING THE APPARATUS

(75) Inventors: Masatoshi Nakajo, Tokyo (JP); Hiroaki Kanazawa, Tokyo (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/526,711

(22) PCT Filed: Sep. 10, 2003

(86) PCT No.: PCT/JP03/11563

§ 371 (c)(1),
(2), (4) Date: Mar. 3, 2005

(87) PCT Pub. No.: WO2004/023911

PCT Pub. Date: Mar. 25, 2004

(30) Foreign Application Priority Data

Sep. 10, 2002 (JP) ..... 2002-263728

(51) Int. Cl.
*B23Q 17/00* (2006.01)

(52) U.S. Cl. ..... 29/407.04; 29/432.1; 29/509; 29/522.1; 29/715; 29/716; 29/788; 29/818; 227/6; 227/119

(58) Field of Classification Search ..... 29/407.04, 29/432.1, 509, 512, 522.1, 523, 715, 716, 29/788, 796, 818; 227/119, 34, 36, 6, 7

See application file for complete search history.

(56) References Cited

U.S. PATENT DOCUMENTS

| | | | | | |
|---|---|---|---|---|---|
| 4,007,537 | A | * | 2/1977 | Silverbush et al. | 29/432.1 |
| 4,019,666 | A | * | 4/1977 | Foults | 227/119 |
| 4,354,588 | A | * | 10/1982 | Wolfertz | 198/394 |
| 4,569,470 | A | * | 2/1986 | Tanaka | 227/119 |
| 4,592,501 | A | * | 6/1986 | Sodeno et al. | 227/119 |
| 4,596,349 | A | * | 6/1986 | Herten | 227/18 |
| 4,641,741 | A | * | 2/1987 | Oura | 198/493 |
| 4,724,991 | A | | 2/1988 | Niijima | |
| 4,978,046 | A | * | 12/1990 | Hagmann et al. | 227/4 |
| 5,301,402 | A | * | 4/1994 | Noel et al. | 29/4 |
| 5,775,566 | A | * | 7/1998 | Kochs et al. | 227/18 |
| 5,781,989 | A | * | 7/1998 | Schmidt | 29/787 |
| 6,072,583 | A | * | 6/2000 | Kellner | 356/614 |

FOREIGN PATENT DOCUMENTS

| | | |
|---|---|---|
| JP | 59-199803 | 11/1984 |
| JP | 62-162006 | 7/1987 |
| JP | 01-192810 | 8/1989 |

* cited by examiner

*Primary Examiner*—David P. Bryant
(74) *Attorney, Agent, or Firm*—Everest Intellectual Property Law Group; Michael S. Leonard

(57) ABSTRACT

A button indexing device used in a button attaching machine for attaching a button to be indexed in a specific orientation on a fabric of garments or the like, including lower mold provided at a button attaching position of the attaching machine, a driving section for turning the lower mold around a vertical axis, a laser beam source for irradiating a laser beam onto a point of a specified circular track of the button to be held in the lower mold around the vertical axis, an optical sensor for detecting light reflected from or scattered by the button, and a stop section for stopping said lower mold in a rotation position capable of obtaining the right orientation when said optical sensor detects the minimum or maximum amplitude.

12 Claims, 8 Drawing Sheets

APPARATUS AND METHOD FOR BUTTON INDEXING IN BUTTON ATTACHING MACHINE, AND METHOD OF ADJUSTING THE APPARATUS

This application is a §371 national stage application of PCT/JP03/11563, filed Sep. 10, 2003, which claims priority to Japanese application 2002-263728, filed Sep. 10, 2002.

TECHNICAL FIELD

The present invention relates to an automatic orientation device capable of rotating a button to a prespecified position in a button attaching machine.

BACKGROUND ART

An attaching machine for attaching buttons each having a design such as a character or a figure thereon to a fabric of garments or the like has widely been used. In the attaching machine as described above, a button (such as, for instance, a decorative button having a attaching leg) is fed from a feed hopper provided in the upper section of the attaching machine to an inclined shoot, then guided through this shoot to a horizontal guide path, and then fed into a receiving section of a lower mold, provided at a button attaching position with use of a push bar which is called pusher. At the button attaching position, an upper mold aligned relative to the lower mold is provided at a lower edge of a plunger which can move up and down, and a concave section for receiving another button (such as a female button or a male button having a receiving section for caulking the attaching leg, for instance, in a fastener) which functions as a partner for the button above is provided in a holding section provided on the bottom surface of the upper mold. After the button is pushed in the lower mold, the pusher is drawn away with a fabric overlaid on the lower mold, and then the plunger is moved down by a driving force to caulk the attaching leg held in the lower mold and hook it in the receiving section for the button held in the upper mold, thus the two buttons being attached on the fabric.

When a button with a character or a figure designed on a surface thereof is attached on a fabric, it is required to accurately position the character or figure on the fabric, and there has been known the method in which an orientation restriction tab is provided on the button to be held in the lower mold and the button is held in the lower mold in the prespecified orientation with using the tab, and there is the device shown in FIG. 1 and FIG. 2 as a representative device for achieving the purpose (Refer to Japanese Patent Laid-Open Publication No. Hei (correctly Sho) 52-60740).

In FIGS. 1 and 2 each showing a button feeder 100 for a button attaching machine, a character or a figure is designed on a surface (a lower surface in the figures) of a button B, while an upright attaching leg L is projected from a rear surface (top surface in the figures) thereof. The button B is fed from a feed hopper (not shown) provided in an upper section of the attaching machine to an inclined shoot 101, guided through this shoot to a horizontal guide path 103, and then is fed into a receiving section of a lower mold (not shown) provided at a button attaching position A.

The horizontal guide path 103 has a slender guide base plate 107, and a straight guide path 103 defined by a first guide member 109 and a second guide member 113 each fixed on a top surface of the base plate and having a substantially inverted T-shaped form, and guides a pusher 105. A forward section of the second guide member 113 (on the side of the button attaching position) forms an adjustable guide member (shown in the partially broken state) with an indexing member 115 provided under the guide member 113 in the state where it can smoothly move, and the indexing member 115 is always biased by a spring 119 restricted by a holding screw 117 toward the guide path 103. An edge section in the guide groove side of the indexing member 115 is inclined with knurls provided with a prespecified space therebetween on a surface thereof to form a knurled surface 121 (FIG. 3), and this knurled surface 121 contacts a rim R of the button pushed by the pusher 105.

As shown in FIG. 2, a concave section 129 having an arresting wall 127 for capturing the tab T of the button and suppressing its rotation is provided on a bottom surface of the pusher 105.

When the button feeder having the indexing mechanism as described above operates, the button B fed into the guide path 103 is pushed by a tip of the pusher 105 driven by a driving force source. When the button reaches a position of the indexing member 115, the rim R of the button B is resisted by the knurls on the knurled surface 121 of the indexing member 115, so that the button starts rotation at a point where it contacts the knurled surface 121 as a supporting point. When the tab T of the button contacts the arresting wall 127 in association with the button's rotation, rotation of the button is stopped and an orientation of the button is fixed. With the operations as described above, the button can be attached at the desired position with the right posture and orientation.

It is generally recognized that the button indexing device described above has an excellent indexing function when handling a metal button, but there is the problem that the function is not fully shown when handling plastic buttons each having a design with a specific orientation such as a character or a figure, which are recently often used. Namely, when a rim of a plastic button contacts the knurled surface 121 of the indexing member 115, the rim is slightly ground, so that grooves between knurls on the knurled surface are filled with the plastics ground off from the plastic button within a relatively short period of time while attaching the plurality of buttons, and therefore the function is degraded with the accurate indexing becoming difficult and sometimes attaching fault to a fabric occurs. It is conceivable to use a frictional material such as rubber in place of the inclined surface, but a lubricant required for smooth operations of the pusher adheres to the inclined surface, which makes the accurate indexing extremely difficult.

DISCLOSURE OF THE INVENTION

A main object of the present invention is to solve the difficulties in the conventional technology described above, and the present invention solves the difficulties in the conventional technology by combining optical detection of an orientation of a button with mechanical adjustment thereof in place of the mechanical indexing method used in the conventional technology.

In other words, features and objects of the present invention are as described below.

(1) The present invention provides a button indexing device used in a button attaching machine for attaching a button to be indexed in a specific orientation on a fabric of garments or the like, said button indexing device includes a lower mold provided at a button attaching position, a driving section for turning the lower mold around a vertical axis, a laser beam source for irradiating a laser beam onto a point of a specified circular track of the button to be held in the lower mold around the vertical axis, an optical sensor for detecting light reflected from or scattered by the button, and a stop section for stopping rotation of the lower mold or for allowing the rotation by a prespecified angle and then stopping it when a maximum or minimum amplitude is detected by the sensor.

In this aspect of the present invention, it is possible to accurately position not only a metal button, but also even a plastic button, and there is provided the advantage that the indexing precision does not become lower even after it is used for attaching buttons for a long period of time.

(2) In the present invention, the optical sensor is preferably provided in the same side as the laser beam source for detecting the return light reflected from the button.

In this aspect of the present invention, the reflected laser beam returns to the same side, so that a system in which the laser beam source and the optical sensor are integrated with each other can be used, which enables downsizing of the device and facilitating the work for assembling the device.

(3) In another preferable aspect of the present invention, the optical sensor is provided in a side contrary to the laser beam source against the vertical axis of the lower mold.

In this aspect, as the reflected light can be effectively used, indexing of a button can precisely be performed by reducing the size of a tab crotch (or a concave section) of the button.

(4) In the aspect (2) of the present invention, it is preferable to provide a section where a light-reflective vertical surface and a light-reflective horizontal surface meet each other and to introduce a laser beam from the laser beam source at a prespecified angle to the horizontal surface and to the vertical surface for irradiating the laser beam onto a point of the circular track.

In this aspect, the reflected light returns to the optical sensor in a track close and substantially parallel to a track of the incident light. Because of this feature, the reflected light can be utilized at the maximum. Especially when an angle of the incident light is set to 45 degrees against the vertical surface as well as to the horizontal surface, the divergence of the reflected light becomes smaller, so that the laser beam source and the optical sensor can be integrated with each other.

(5) Similarly in the aspect (2) of the present invention described above, it is preferable to provide a light-reflective inclined surface on a button and to irradiate a laser beam from the laser beam source onto a point of the circular track by introducing the laser beam at a prespecified angle to the inclined surface.

Even in this aspect of the present invention, the reflected light returns to the optical sensor along a track close to that of the incident light. Because of this feature, the reflected light can be utilized at the maximum. Especially when an angle of the incident light is set to 90 degrees against the inclined surface, the divergence of the reflected light becomes smaller, so that the laser beam source and the optical sensor can be integrated with each other.

(6) In still another aspects of the present invention, the button attaching machine using the button indexing device as described above includes an upper feed hopper, an inclined shoot connected to the feed hopper, a guide mechanism having a guide path for receiving a button from the inclined shoot, a pusher for pushing the button, a lower mold provided at a button attaching position adjacent to an exit of the guide path for receiving and holding the button therein, an upper mold provided at a position opposite to the lower mold for receiving and holding another button to be jointed to the button above therein, and a plunger for moving up and down the upper mold.

(7) Further the present invention provides a button indexing device in a button attaching machine for attaching buttons each requiring a specific orientation on a fabric of garments or the like, and the button indexing device includes a lower mold provided at a button attaching position in the attaching machine, a driving unit for turning the lower mold around the vertical axis thereof, a laser beam source for irradiating a laser beam onto a point on a prespecified circular track around the vertical axis of the button to be held in the lower mold, a portion of a reflecting or scattering surface of the button where light scattering is minimum, an optical sensor for detecting the reflected light or scattered light from the reflecting or scattering section of the button, and a stop section for stopping the lower mold at a rotational position where the button can be oriented in the right direction when the optical sensor detects the minimum amplitude.

For instance, by employing the reflecting or scattering section of the button with the maximum reflexivity or scattering capability at a position of the circular track where the light is substantially reflected or scattered, a concave section is provided on the surface so that the reflection or scattering occurs at the minimum on the reflection surface.

Because of this feature, the button can be indexed with the right orientation by detecting the minimum amplitude after the reflected or scattered light with the high amplitude is detected and also by turning the button by a prespecified angle.

It is to be noted that the present invention is applicable not only to the button attaching machines each having the configuration as described above, but also to other ones having the various configurations respectively.

As described above, with the present invention, the mechanical indexing device as that used in the conventional technology is not required, and a button attaching machine which can simply supply a button to a lower mold at a attaching position may be used, and by combining a reflection surface for positional detection, provided on a button, a laser beam source, and an optical sensor together and also by turning the lower mold to a position where amplitude of the detected light is maximum, a position of the button can be set with high precision, so that high precision button indexing which has been impossible in the conventional technology can be performed.

Further, as an amplitude of the reflected light or scattered light varies according to a material or a color of the button to be attached, it is necessary to previously decide the maximum amplitude of the detected light for each type of button before the work for attaching the buttons is started. Namely, it is necessary to previously decide a position where rotation of the lower mold is to be stopped for each type of button by previously measuring a light amplitude curve of the reflected light or the scattered light along the circular track for each type of button with any of the button indexing devices (1) to (5) above and correlating a position for the maximum amplitude to a regular orientation of each button.

With the configuration as described above, in a method of indexing a button in a attaching machine for attaching a button requiring a specified orientation on a fabric of garments or the like, the work for indexing the button can precisely be carried out by feeding the button to a lower mold provided at a button attaching position in the attaching machine, turning the lower mold holding the button therein around the vertical axis, irradiating a laser beam onto a point of a prespecified circular track around the axis of the button to detect the reflected light or scattered light from the button, and stopping rotation of the button at a position where the button is oriented in the right direction. The rotational position of the lower mold when the maximum light amplitude is detected may be the same as or different from the position where the right orientation of the button is obtained, but the two angular positions have a constant relation, so that it is required only to previously store a rotational angle from the maximum amplitude position to the position where rotation of the lower mold is stopped in a control circuit for the rotary motor.

BEST MODE FOR CARRYING OUT THE INVENTION

The present invention is described in detail below with reference to attached drawings.

Figure 10:
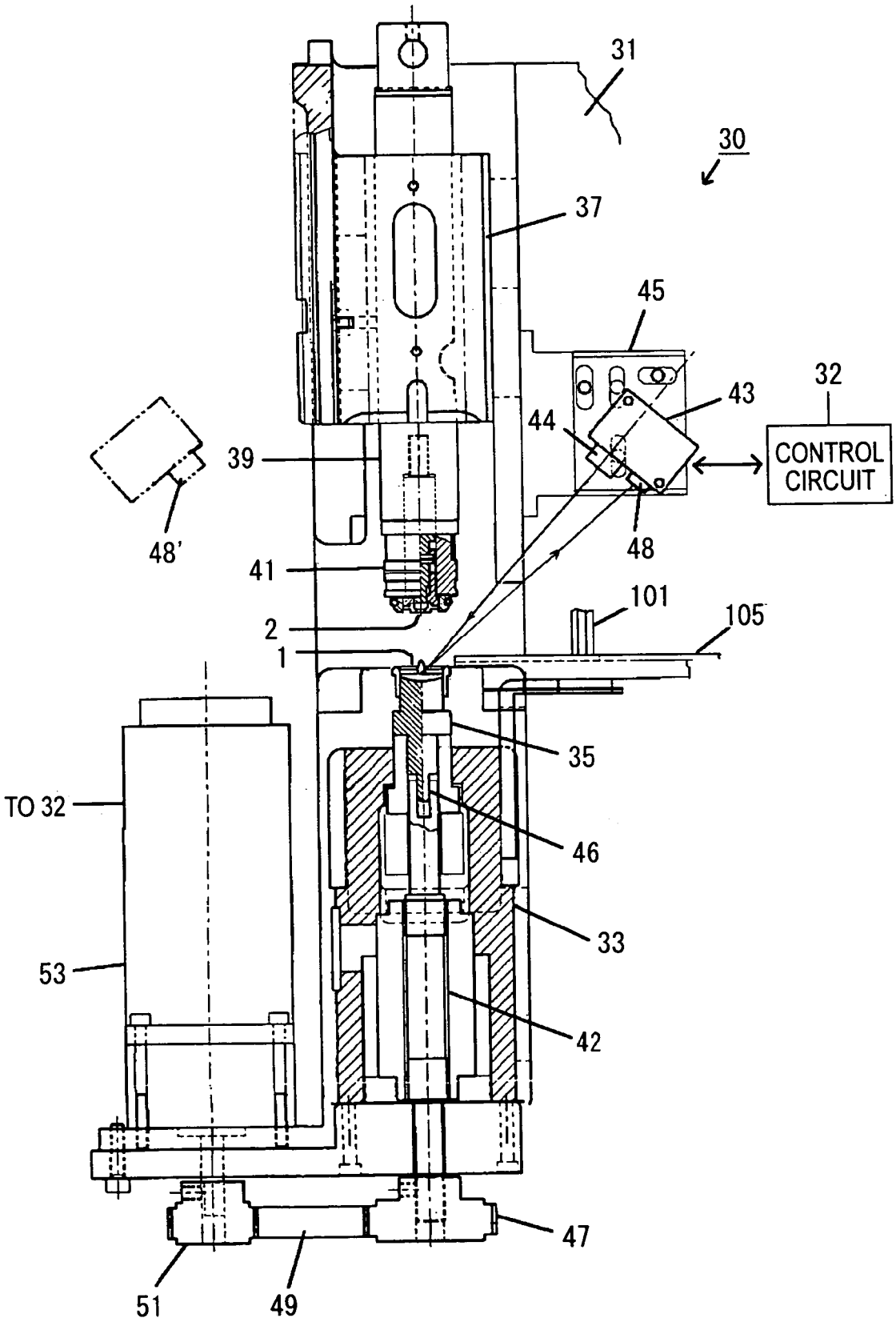
FIG. 10 is a front elevational view showing a partially broken cross section of an attaching machine having the button indexing device according to the present invention.
Figure 11:
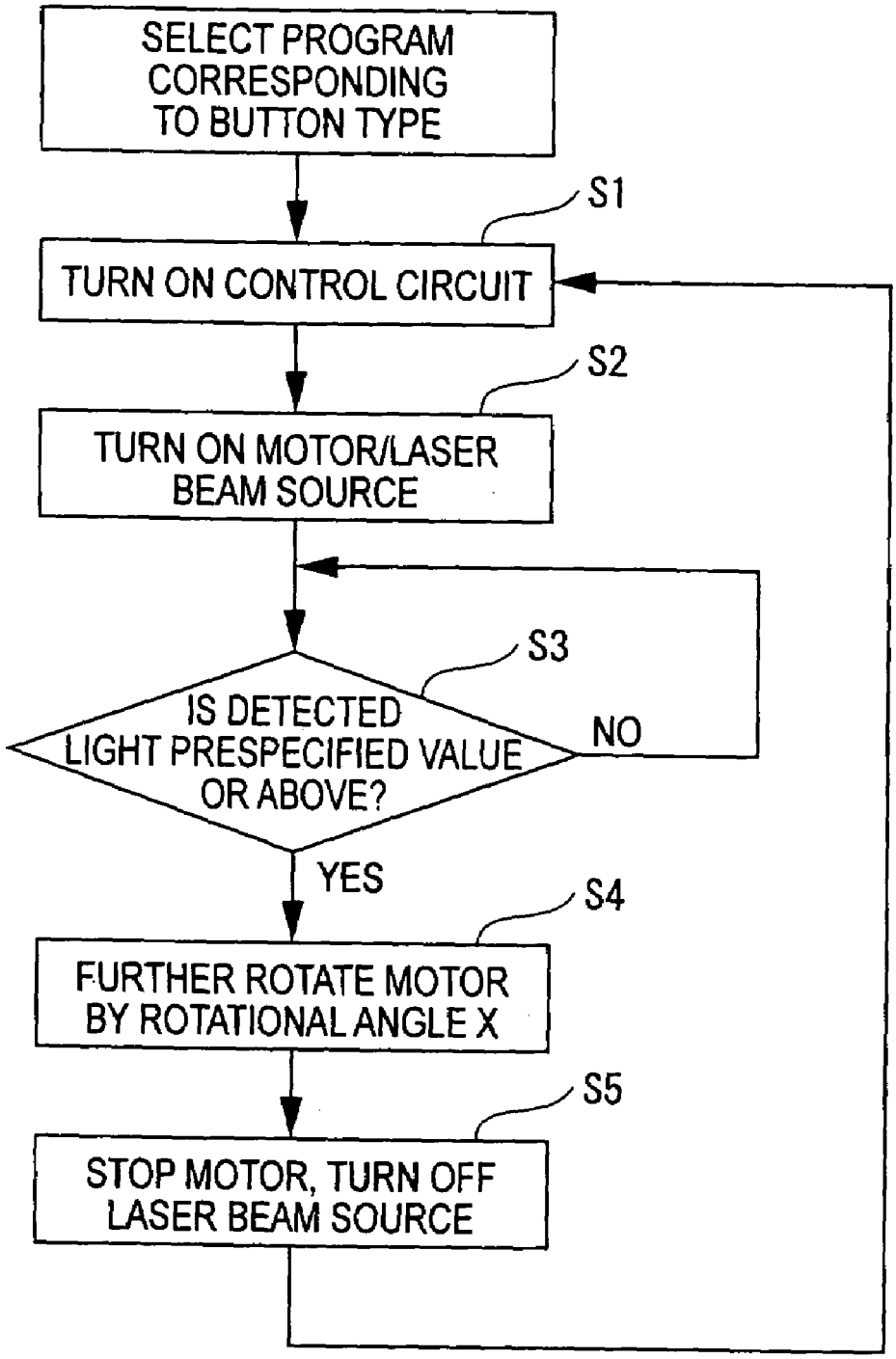
FIG. 11 is a flow chart showing operations of the button indexing device according to the present invention.
Figure 12:
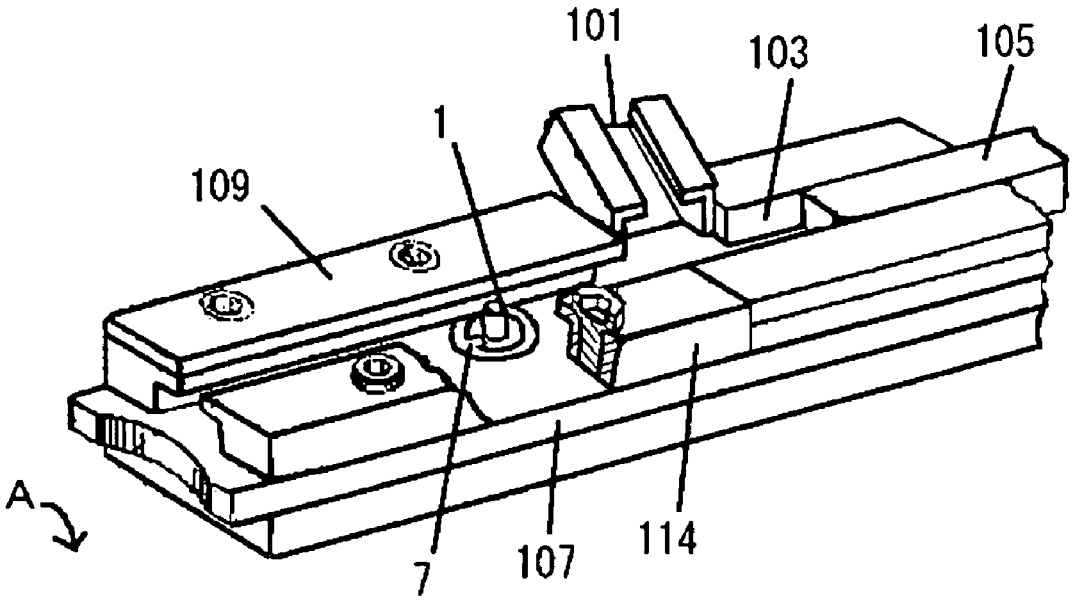
FIG. 12 is a perspective view showing an example of a button feeder which can be used in the present invention.

FIG. 10 to FIG. 12 each show a button attaching machine having a button indexing device according to preferred embodiments of the present invention. In each of the embodiments, an integrated type of button attaching machine, in which a laser beam source and an optical sensor for detecting reflected or scattered light are accommodated side by side in the same housing is used. With this configuration, space saving is possible, and also assembly of the device is easy, but a device in which the laser beam source and the optical sensor are not integrated with each other may be used.

In the light detector, the structure in which the laser beam source and the optical sensor are close to the vertical line including a tab of the button is most efficient from the view point of efficient use of the light, but as it is physically impossible to fix it within a moving path of a mold, the laser beam source and the optical sensor in the light detector are required to be located and fixed in both sides of the axial line respectively or in one side thereof side by side. However, in a case where a mechanism for correlating movement of the laser beam source and optical sensor with movement of a mold so that the laser beam source and optical sensor escape outward when the upper mold comes down is employed, the present invention is applicable, but in this case the structure is complicated, and therefore a case where the laser beam source and the optical sensor are located at the fixed positions respectively is described below.

In the present invention, by improving a form of a section formed on a button and having a reflection surface for detecting orientation so that amplitude of the light to be detected is maximized (such as, for instance, a tab), the problem of attenuation of luminous energy can be evaded. Namely, the following cases (a) to (d) are conceivable.

(a) The laser beam source and the optical sensor are indexed side by side, and a reflection surface of the tab is inclined at a predetermined angle to the laser beam, so that the light reflected from or scattered by the tab can be detected at the maximum position. No problem occurs when the reflected light can be detected, but also the scatter light is allowable, and in this case, the angle of the incident light and return light to the sensor is at maximum 30 degrees. An angle of the incident light to the reflection surface is 60 degrees at maximum. When the angles are outside the ranges described above, a quantity of detectable scattered light is reduced.

Figure 4:
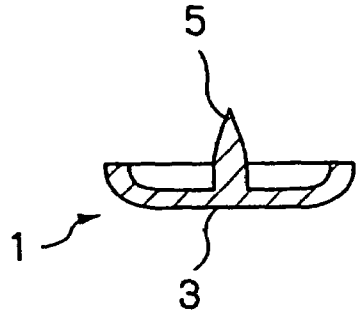
FIG. 4 is a front cross-sectional view showing a structure of a tab of a button to be indexed with a device according to the present invention.
Figure 5:
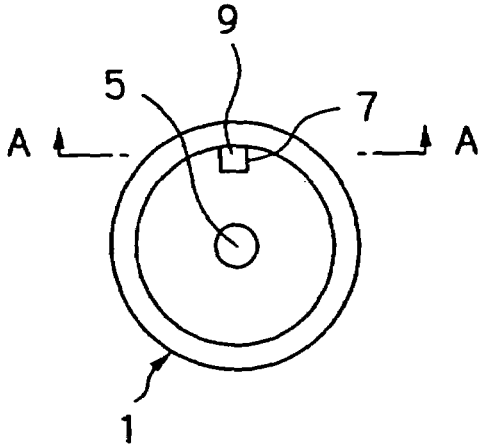
FIG. 5 is a plan view showing a structure of the tab of the button to be indexed with the device according to the present invention.
Figure 6:
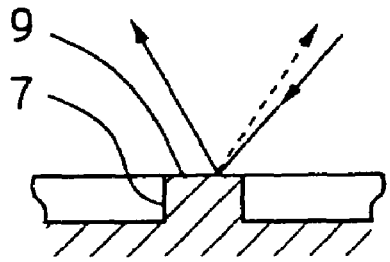
FIG. 6 is an enlarged view showing the structure of the tab of the button to be indexed with the device according to the present invention taken along the line A—A in Fig. b (correctly FIG. 5)

FIGS. 4 to 6 each show an example of a button adapted for indexing, and FIG. 4 is a front cross-sectional view, FIG. 5 is a plan view, and FIG. 6 is an enlarged cross-sectional view taken along the line A—A, and a small tab 7 (having a predetermined angular relation with the regular orientation of a design) is provided on a surface of a the button 1 having a surface 3 with a character or a figure, which has the orientation, designed thereon and a attaching leg 5 which can be caulked, the surface attached onto a fabric, and the upper surface is used as a reflection surface. In this case, the reflection surface may or may not have luster on the condition that the surface's capability of reflecting or scattering the light is large within a circular track. In these cases, a button orientation detector in which the laser beam source and the optical sensor are integrated with each other is used, and the reflected or scattered light along the dotted line for the incident light along the solid line is detected. When the reflected light is to be detected, the optical sensor is provided in a path of the light reflected along the solid line symmetrical to that of the incident line against the normal line to the reflection surface. In any case, the button must be designed according to a structure of the button orientation detector.

Figure 7:
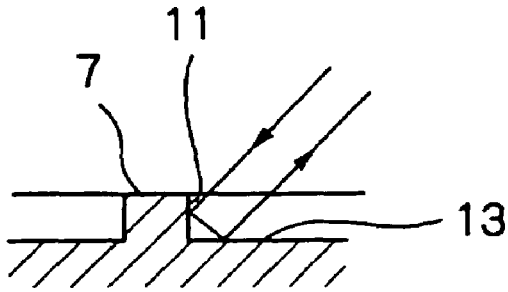
FIG. 7 is an enlarged cross-sectional view showing another example of button like that shown in FIG. 6.

(b) FIG. 7 shows a case in which a side face of the tab includes a vertical surface and a horizontal surface, and when a laser beam is irradiated onto the portion where the two surfaces meet each other, a substantial portion of the reflected light goes toward the optical sensor.

The button shown in FIG. 7 has a tab form adapted to use of the integrated type of button orientation detector, and in this case a vertical reflection surface 11 and a horizontal reflection surface 13 are provided at the side of the tab 7, and other portions are differentiated, for instance, by means of delustering. The laser beam is introduced onto the reflection surface 13. As all the incident light is reflected and returned in a direction reverse to the incident direction, the position of reflection with the maximum amplitude can easily be detected. In this example, as the reflected light returns to the original point irrespective of the incident direction of the laser beam, it is easy to design the indexing device. Also when a concave section is used in place of the tab, the same principle is applicable on the condition that the same functional surface portion as that described above is provided.

Figure 8:
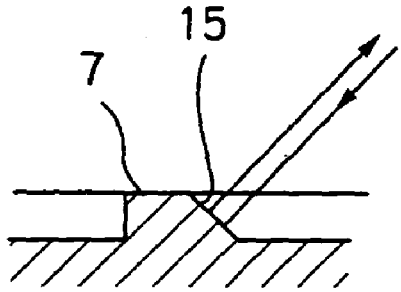
FIG. 8 is an enlarged cross-sectional view showing still another example of button like that shown in FIG. 6.

(c) FIG. 8 shows a case in which a side face of the tab is inclined substantially at the right angle to the incident light, and a substantial portion of the reflected light goes toward the optical sensor.

FIG. 8 shows a case where an inclined surface 15 perpendicular to the incident light is provided on a side face of the tab 7. Also in this case, substantially all the light is reflected and returns in a direction reverse to the incident direction, so that a position for reflection with the maximum amplitude can easily be detected. Further even if the incident light is inclined to the inclined surface 15 to some extent, the reflected light or the scattered light having sufficient amplitude can be detected. Also when a concave section is used in place of the tab, the same principle is applicable on the condition that the same functional surface portion as that described above is provided.

Figure 9:
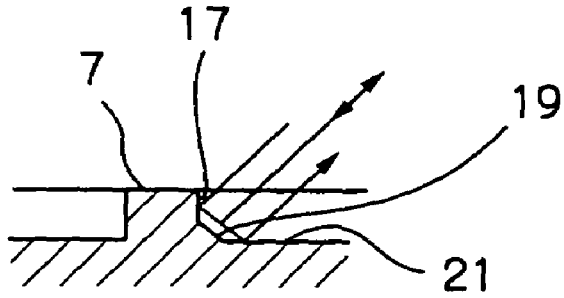
FIG. 9 is an enlarged cross-sectional view showing further example of button like that shown in FIG. 6.

(d) FIG. 9 shows an eclectic type in which the type (c) and type (d) are combined.

This (translator's comment; the original document lacks "this") is an eclectic type in which the type shown in FIG. 7 and type shown in FIG. 8 are combined with each other, and this button has a vertical reflection surface 17, an inclined reflection surface 19, and a horizontal reflection surface 21. Also when a concave section is used in place of the tab, the same principle is applicable on the condition that the same functional surface portion as that described above is provided.

Figure 1:
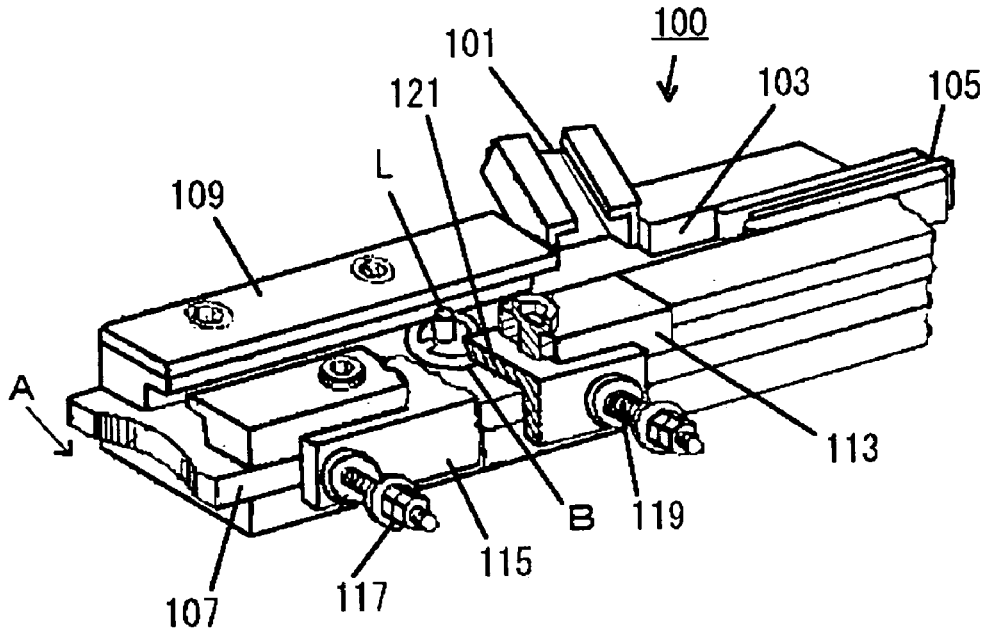
FIG. 1 PRIOR ART
FIG. 1 is a perspective view showing a button indexing device based on the conventional technology.
Figure 2:
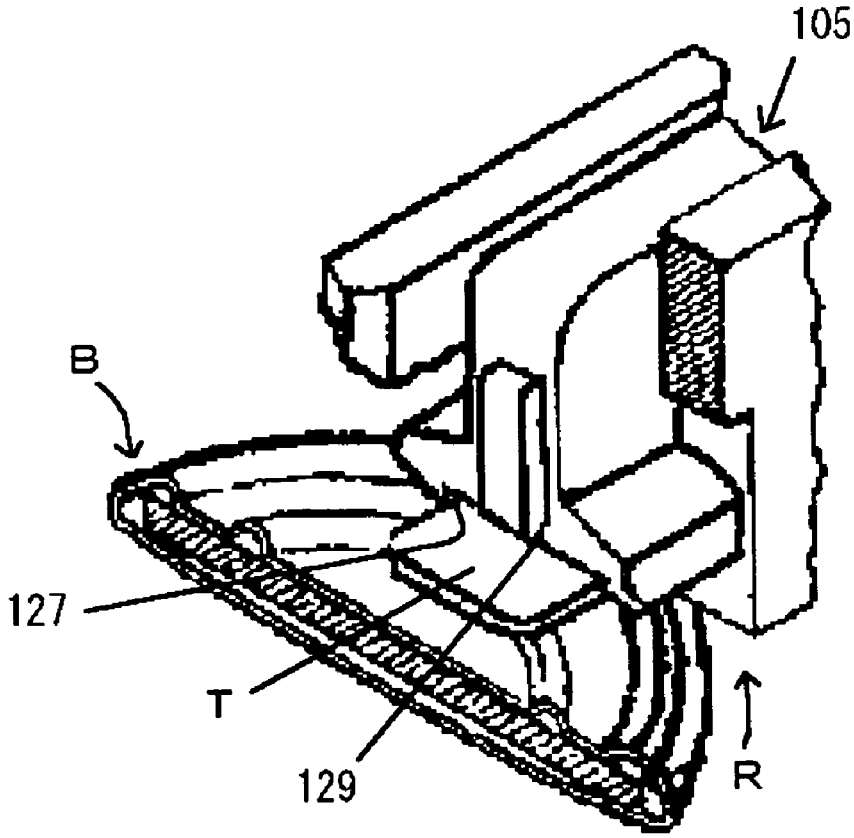
FIG. 2 PRIOR ART
FIG. 2 is an enlarged view showing a primary portion of the button indexing device based on the conventional technology.
Figure 3:
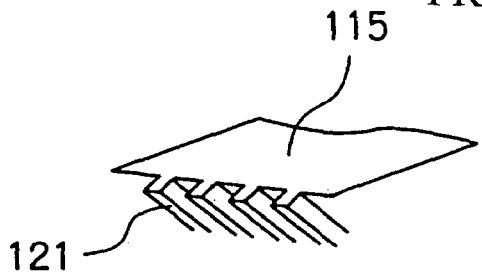
FIG. 3 PRIOR ART
FIG. 3 is a view showing a knurled surface of the button indexing device based on the conventional technology.

The indexing device used in the button attaching machine using the buttons as described above is described below with reference to FIG. 10 and on. At first, the structure of the attaching machine is more simple as compared to that shown in FIG. 1 and FIG. 2, and the conventional type of indexing device having a knurled surface is not used.

In FIG. 10, an attaching machine 30 has a machine frame 31, and attached to this machine frame is a rotational indexing section 33 supporting a lower mold 35 thereon. A plunger 39 capable of moving up and down and supporting an upper mold 41 is supported by a cylinder section 37 on the machine frame so that the plunger can move up and down. A given button (a socket, stud, or other known one in a case of a snap button) to be fixed on a fabric or the like is supported in combination with the button 1 indexed according to the present invention is supported in the upper mold 41. The axial line of the upper mold 41 is the same as that of the lower mold 35. Further, attached to a support bracket 45 mounted on the machine frame is a button orientation detector 43 in which a laser beam source 44 and an optical sensor 48 are integrated with each other, and the button orientation detector 43 is arranged so that, when a laser beam is irradiated onto one point of a circular track including a prespecified reflection surface (Refer to FIG. 6 to FIG. 9) of the tab 7 of the button surface (attaching surface) supported by the lower mold 35 to detect the light reflected from or scattered by the surface. In the case where the attaching machine is designed so that a button with a tab having the horizontal reflection surface as shown in FIG. 6 is to be used, only the laser beam source is used in place of the button orientation detector 43, and an optical sensor 48' is provided at a position with the axial line of the lower mold therebetween.

A lower edge of the lower mold 35 has a deformed cross section 46 (a flat plate in the case shown in the figure) and is supported by a deformed slot complementary to an upper edge of the rotational indexing shaft 42, and the lower mold 35 rotates in association with rotation of the shaft 42. A pinion 47 is fixed to a peripheral surface of the lower edge of the shaft 42, and is connected to an output pinion 51 of an electric motor 53 via a rack belt 49.

The electric motor 53 is turned ON or OFF by a control circuit 32 which operates in response to a light amplitude signal from the optical sensor 48 in the button orientation detector 43. For instance, the control program as shown in FIG. 11 is used for the control circuit. This point is described hereinafter.

The button feeder used in this case is that shown in FIG. 12. This button feeder feeds a button from a feed hopper (not shown) in the upper section of the attaching machine to an inclined shoot 101, guided from this shoot to a horizontal guide path 103, and then the button 1 is sent by a pusher 105 into a receiving section of a lower mold (Refer to FIG. 10) located at the button attaching position A. To facilitate understanding, a case in which a button feeder for feeding a button from the side of the device is shown in FIG. 10, but extension in the longitudinal direction (in the direction normal to the figure plane) in succession to a rear section of the lower mold is preferable for space saving.

The horizontal guide path 103 is defined by a slender guide base plate 107, a first guide member 109, and a second guide plate 114 each fixed on the top surface of the base plate with a substantially inverted T-shaped linear form, and guides the pusher 105. The button 1 fed to the guide path 103 is pushed by a tip of the pusher 105 driven by a power from a driving force source (not shown).

Then an example of button indexing operations according to the present invention is described below with reference to FIG. 10 to FIG. 12. As the tab detector, one in which a laser beam source and an optical sensor are integrated with each other is used in this example.

At first, a program for the indexing control circuit corresponding to a type of the button (storing therein data for reflection amplitude in tab detection, and a rotational angle X from the tab detecting position to the regular position) is selected. When selecting the program, it is necessary to previously decide the maximum detection amplitude for each type of button before starting the button attaching work, because amplitude of the reflected or scattered light varies according to a material and a color of the button to be attached. Namely, with using the button indexing device according to above described examples (1) to (5), the light amplitude curve indicating amplitudes of the reflected light or scattered light along the circular track is measured for each type of button 1 beforehand, and the obtained value of the peak amplitude or a value close to the peak amplitude when the maximum amplitude for the light returning from the reflection surface provided on the tab 7 is detected by the optical sensor is stored in a memory of the control circuit 32 as the reference value, and at the same time the rotational angle X from the angular position to the regularly-oriented angle then is measured and stored in the control circuit.

In FIG. 12, the button attaching machine is started, and a button is guided from a button feed hopper (not shown) via the shoot 101 to the guide path 103. The button 1 is guided to the guide path 103 with the attaching leg and the tab 7 facing upward. Then the pusher 105 pushes the button from the guide groove to a receiving section of the lower mold 35 at the attaching position A shown in FIG. 10.

In FIG. 11, when the control circuit 32 is turned ON (S1), the motor 53 and the button orientation detector 43 are turned ON, and the shaft 42 supporting the lower mold starts its rotation (S2). A laser beam from the laser beam source 44 in the button orientation detector 43 is irradiated to the reflection surfaces 11, 13, or 15, or 17, 19, 21, and returned as reflected light or scattered light to the optical sensor 48. The control circuit 32 repeatedly compares the prespecified amplitude levels stored therein to the light amplitude actually detected with a prespecified time interval (S3), and when the detected amplitude matches any of the stored amplitudes, the control circuit 32 further rotates the motor 53 by the angle X (an angle of 0 or more degrees up to the regular angle decided in the preparatory detection work) (S4), and then turns OFF the motor 53 and the laser beam source 44. Thus the button is indexed in the right orientation. This cycle is repeated according to the necessity.

On the other hand, a male button or female button 2 has been fed from the similar feed hopper and held therein a concave section at the lower edge of the upper mold 41. A prespecified position of a fabric of garments or the like is located at the attaching position A, and the button 2 set in the upper mold 41 is oriented to the button 1 indexed as described above and pressed toward the button 1 held in the concave section at the upper edge of the lower mold 35 by driving the plunger 39 with a treadle pedal or the like. With this operation, the leg 5 (FIG. 4) of the button 1 penetrates the fabric, pass through a central hole of the button 2 with the tip caulked to pull the button 2 toward the button 1, thus the buttons being attached at the prespecified position on the fabric or the like with the right orientation.

Incidentally, the present invention is not limited to the embodiments described above, but modifications or the like as described below are also included in the scope of the present invention.

For instance, a section with low reflexivity or low scattering capability such as a light-reflective or light-scattering concave section, or mat face may be provided on a central portion of the reflection surface 9 shown in FIG. 5 or on the inclined surface 15 shown in FIG. 8, to scatter the light. As this configuration is employed, the reflected light from the reflection surface 9 or 15 is detected with the minimum reflection amplitude between strong detection amplitudes when the button is rotated. Because of this feature, a position of the button can accurately be detected, and an accurate orientation of the button can be obtained by making use of the detected positional data. FIG. 11 with applicable correction may be used as a control flow for realizing the modification described above. For instance, an additional step of further determining the detection of the amplitude lower than the prespecified minimum amplitude when a result of checking in S3 is YES may be added.

In the modifications as described above, the following examples are conceivable. (1) When a low-reflexivity section provided on the highly reflective or scattering surface of the button is simply a concave section, by focusing the laser beam with a focusing lens onto the highly reflective surface, a quantity of the reflected light to the sensor due to divergence of the light is minimized at the bottom of the concave section. (2) When a low-reflexivity section provided on the highly reflective or scattering surface of the button is a concave section having the scattering bottom (such as a mat face or a hemispherical surface), the laser beam may be either focused beam or parallel one, and an angular position of the button where the reflection of light in the direction to the sensor, is minimized when the laser beam is irradiated onto the bottom surface of the concave section is detected. (3) When the low-reflexivity section provided on the highly reflective or scattering surface of the button is not a concave section, but is simply a mat face, the laser beam may be focused with a lens onto the highly reflective surface, or a parallel beam may be irradiated thereto to utilize the fact that the light amplitude detected by the sensor is minimized when the incident laser beam is reflected on or scattered by the mat face.

As described above, a key point of the present invention is that, when a lower mold provided at a button attaching position in a attaching machine is rotated around the vertical axis thereof, a laser beam is irradiated on a point of a circular track including a reflection surface of the tab to detect the tab position by checking the reflection amplitude, and the button is rotated up to an angular position where the correct orientation is obtained according to the detected data. By improving the structure of the tab reflection surface of the button to maximize the reflection amplitude, precise indexing can be performed by maximally using the quantity of detected light.

INDUSTRIAL AVAILABILITY

The present invention relates to an automatic orientation device for rotating a button to a prespecified position when the button is to be attached, and can be used in a attaching machine for attaching buttons each having a character, a figure or the like designed on the surface thereof on a fabric of garments or the like.

The invention claimed is:

1. A button indexing device used in a button attaching machine for attaching a button to be indexed in a specific orientation on a fabric comprising: a lower mold provided at a button attaching position of said button attaching machine; a driving section for turning the lower mold around a vertical axis; a laser beam source for irradiating a laser beam onto a point of a specified circular track of the button to be held in the lower mold around the vertical axis; an optical sensor for detecting light reflected from or scattered by the button; and a stop section for stopping said lower mold in a rotation position capable of obtaining the right orientation when said optical sensor detects the minimum or maximum amplitude.

2. The button indexing device according to claim 1, wherein said button needs to be indexed in a specific orientation and has a reflecting or scattering surface thereon, said reflecting or scattering surface having a portion with the least or the most reflection or scattering, and the stop section for stopping said lower mold in the rotation position capable of obtaining the right orientation is the section in which the portion with the least or the most reflection or scattering provided on said reflecting or scattering surface is sensed when said optical sensor detects the minimum or maximum amplitude, and upon this detection said lower mold is stopped in the rotation position capable of obtaining the right orientation.

3. The button indexing device according to claim 1, wherein said optical sensor is provided in the same side as the laser beam source for detecting the return light reflected from the button.

4. The button indexing device according to claim 3, wherein said button is provided with a light-reflective vertical surface and a light-reflective horizontal surface meeting to each other to introduce a laser beam from said laser beam source at a prespecified angle to said horizontal surface and vertical surface.

5. The button indexing device according to claim 3, wherein said button is provided with a light-reflective inclined surface and a laser beam from said laser beam source is introduced at a prespecified angle to said horizontal surface and vertical surface for irradiating a point of said circular track.

6. The button indexing device according to claim 3, wherein said laser beam source and said optical sensor are provided side by side in the substantially same position so that an incident light and a reflecting light to said button go back-and-forth at a corresponding inclined angle.

7. The button indexing device according to claim 1, wherein said laser beam source is provided in a side contrary to said optical sensor against the vertical axis of the lower mold.

8. The button indexing device according to claim 7, wherein said laser beam source and said optical sensor are provided side by side in the substantially same position so that an incident light and a reflecting light to said button go back-and-forth at a corresponding inclined angle.

9. The button indexing device according to claim 7, wherein said button is provided with a tab crotch or a concave section having a light-reflective horizontal surface, and a laser beam from said laser beam source irradiates a point of said circular track including said horizontal surface.

10. The button indexing device according to any one of claims 1 to 7, wherein a button attaching machine comprises a feed hopper provided in the upper section thereof, an inclined shoot connected to said feed hopper, a guide mechanism having a guide path receiving a button from said inclined shoot, a pusher for pushing the button, the lower mold provided at a button attaching position adjacent to an exit of said guide path for receiving and holding the button, an upper mold provided opposing to said lower mold for receiving and holding another button to be jointed to said button, and the plunger for moving said upper mold up and down.

11. A method of adjusting a button indexing device in a button attaching machine for attaching a button to be indexed in a specific orientation on a fabric of garments or the like, comprising the steps of:

using the button indexing device comprising a lower mold provided at a button attaching position of said button attaching machine, a driving section for turning the lower mold around a vertical axis, a laser beam source for irradiating a laser beam onto a point of a specified circular track of the button to be held in the lower mold around the vertical axis, an optical sensor for detecting light reflected from or scattered by the button, and a stop section for stopping said lower mold in a rotation position capable of obtaining the right orientation when said optical sensor detects a maximum or minimum amplitude; and measuring a light amplitude curve of reflected light or scattered light along said circular track in accordance with the type of buttons, and predetermining the rotation stopping position of said lower mold by the position with maximum amplitude associating with the regular button orientation.

12. A method of indexing a button in a button attaching machine for attaching a button to be indexed in a specific orientation on a fabric comprising the steps of:

providing a reflecting or scattering surface on the button, and providing a portion with the least or the most reflection or scattering on said reflecting or scattering surface;

using a button indexing device comprising a lower mold provided at a button attaching position of said button attaching machine, a driving section for turning said lower mold around a vertical axis, a laser beam source for irradiating a laser beam onto a point of a specified circular track of the button to be held in the lower mold around the vertical axis, an optical sensor for detecting light reflected from or scattered by the button; and sensing a portion with the least or the most reflection or scattering provided on said reflecting or scattering surface by said optical sensor detecting the minimum or maximum amplitude, and stopping said lower mold in a rotation position capable of obtaining the right orientation.

* * * * *